US006490763B2

(12) United States Patent
Tamura

(10) Patent No.: US 6,490,763 B2
(45) Date of Patent: Dec. 10, 2002

(54) ROLL-KNOT NECKTIE CLIP

(76) Inventor: Genichi Tamura, 3-29, Sumikawa 5-jo 3-chome, Minami-ku, Sapporo Hokkaido (JP)

( * ) Notice: Subject to any disclaimer, the term of this patent is extended or adjusted under 35 U.S.C. 154(b) by 0 days.

(21) Appl. No.: 09/767,813

(22) Filed: Jan. 24, 2001

(65) Prior Publication Data

US 2002/0124361 A1 Sep. 12, 2002

(30) Foreign Application Priority Data

Feb. 18, 2000 (JP) ..... 2000-105638

(51) Int. Cl.[7] ..... A41D 25/02

(52) U.S. Cl. ..... 24/49.1; 24/53; 24/54; 24/65; 2/157

(58) Field of Search ..... 24/49.1, 52, 53, 24/65; 2/150, 157

(56) References Cited

U.S. PATENT DOCUMENTS

| | | | | | |
|---|---|---|---|---|---|
| ,299,078 | A | * | 5/1884 | Kubec | 24/65 |
| ,450,248 | A | * | 4/1891 | Metz | 24/49.1 |
| ,573,733 | A | * | 12/1896 | Waterbury | 24/49.1 |
| ,642,480 | A | * | 1/1900 | Perkins | 24/49.1 |
| ,661,425 | A | * | 11/1900 | Redington | 24/49.1 |
| 1,810,077 | A | * | 6/1931 | Hengstler | 24/49.1 |
| 1,968,401 | A | * | 7/1934 | Kapfer | 24/53 |
| 2,667,642 | A | * | 2/1954 | Ely | 2/157 |
| 2,732,558 | A | * | 1/1956 | Booker | 2/157 |
| 3,745,614 | A | * | 7/1973 | Tsang | 24/49.1 |
| 3,964,105 | A | * | 6/1976 | Gideon | 2/152 |
| 3,999,222 | A | * | 12/1976 | Walborn | 2/150 |

FOREIGN PATENT DOCUMENTS

| | | | | |
|---|---|---|---|---|
| DK | 0006970 | * | 11/1903 | 24/49.1 |
| GB | 0005413 | * | 11/1883 | 24/53 |
| GB | 0010235 | * | 5/1890 | 24/53 |
| GB | 0020893 | * | 9/1900 | 24/54 |
| GB | 0019675 | * | 8/1902 | 24/53 |

* cited by examiner

*Primary Examiner*—Victor Sakran
(74) *Attorney, Agent, or Firm*—Koda & Androlia

(57) ABSTRACT

The invention offers a clip that makes it possible to use any necktie as is by the enabling the simple tying of a necktie knot with a single step.

The invention is a roll-knot necktie clip that is formed from a holding frame (1) having a claw-shaped catch section (2*a*) and an inside holding frame (4*a*) in the shape of a ring that is joined to the base (5) by a connector plate (8).

The second working example of the invention is an improved version made from the first working example and is formed from the holding frame (1) and the inside holding frame (4*a*). The second working example makes it possible to form a knot in nearly a single step without the use of a screw or other device by folding the inside of the essential part (14) and holding this in the inside holding frame, then inserting the outside (11*a*) and inside (11*b*) of the necktie (11*b*) that are overlapped in a U-shape into the holding frame.

Because the invention clip makes it possible to use any necktie without changing the tie, the invention has the advantage of allowing users to select from nearly unlimited types of neckties without having to sacrifice individuality.

5 Claims, 6 Drawing Sheets

ROLL-KNOT NECKTIE CLIP

BACKGROUND OF THE INVENTION

The invention concerns a roll-knot necktie clip.

It is a clip for tying neckties easily that eliminates the past complications of tying neckties. There are numerous types of devices currently on the market that relate to simple tying of neckties. These devices have the same general purpose as the invention. However, the specific purpose of the invention is more limited and does not relate to other inventions for which patent application has been made.

The invention is a device to arrange the shape and form of a necktie such that the necktie crosses and narrows at the neck section of the part of the tie that hangs in front, without tying a knot. Thus the invention is a clip for the wearing of neckties utilizing a tying method called a roll knot, similar to way mufflers or ascot ties are tied.

While there are no roll-knot clips on the market, the following inventions have been published in public patent bulletins.

1. Patent Announcement No.144113 (1996)
2. Patent Announcement No.3809 (1998)

Products with the same objective as the invention in a broad sense, that is, various kinds of simple necktie clips, are already on the market. Moreover, the number of applications to the Patent Office is substantial.

But while the motivation for inventing a simple necktie clip is the same, comparative examples cannot be provided here because in the narrow sense (roll-knot necktie clip), the purpose for creating the invention is different.

As indicated above, products for the same purpose as the invention in the narrow sense—that is, roll-knot tie clips —are not found on the market.

The patent application devices quoted above in 1 and 2 have the following problems. The aim of the invention is to resolve these problems.

1. The quoted inventions (Patent Announcement No.144113 (1990) and Patent Announcement No.3809 (1998); hereinafter: "the quoted inventions") use a screw or similar object to narrow and insert the essential part of the necktie.
2. Inserting the essential part of the necktie and tightening the screw appears simple on explanation diagrams, but it is bothersome to practice, because half of the necktie can slip out of place while the other half is being held in place.
3. There is a danger of damaging the necktie when tightening the screw, because ties are not made from materials of the same quality as the metal screw and great force is exerted on a small area of the soft cloth, a weaker material.
4. Forcefully tightening the screw will damage the necktie, whereas the tie may easily slide off the clip if the force of the screw is too weak.
5. A much simpler approach is preferable for this type of device. The quoted inventions, however, all require screws, are complicated in structure, and are expensive to manufacture because of their numerous parts.

The imperfections of the quoted inventions can be cited as the reason that it has not been possible to make them commercially available. They are not simple enough to be worn effectively, the necktie may slip off the clip more easily than expected depending on the screw strength, and they fail to meet the need for improved necktie use.

The invention aims to be an appealing product that can solve these problems through very simple manufacture and exceptional ease of use.

SUMMARY OF THE INVENTION

The invention characteristics are as follows.

1. The invention consists of an holding frame used as a catch section that is formed by extending both tips of a narrow, short plate of metal or similar material bent into a U-shape, at right angles towards each other such that they form a claw shape, and a stopper made of some material such as plastic that has been formed into a spindle that is slightly indented in the center.

The user first squeezes the tie at the back of the tie knot that corresponds to the knot of the necktie when tied in a roll knot and overlaps the front and inside part of the necktie to be held by the claw-shaped catch section, using the elasticity of the entire metal frame. The user then inserts the stopper from below and inside the inserted necktie and makes sure the tie is securely inserted by the clip and stopper and the necktie is firmly fixed.

The holding frame and stopper are analogous to a nut and bolt, working together to form the necktie clip.

2. Rather than bend the catch section into a claw shape, the identical result can be achieved by bending it into a loop; or attaching caps or balls made of some frictional materials such as rubber or plastic to both tips without bending them. When a hard round substance such as pearl is used, the same effect as a spherical catch section made of frictional materials such as plastic can be achieved by applying a friction agent such as silicon to the inside of the hard spherical body.
3. The stopper can be made of frictional materials such as plastic in the shape of a spindle that is slightly indented in the center portion; or of a slender metal plate in the shape of a spindle that is slightly indented in the center when seen from the side.
4. By forming an inside holding frame shaped like a ring that is slightly open at the tips and connecting it to the holding frame by a short plate such that both pieces are joined at the base, the inside holding frame maintains the insertion unit so a necktie can be tied firmly without having to use a stopper. This substantially improves ease and reliability of use.
5. The inside holding frame can also be formed by continuing to bend the bottom of the U-shaped unit directly at right angles into a forked shape and extending the tips to the prescribed length.
6. The inside holding frame can also be formed by directly extending the bottom section of the U-shaped body to the prescribed length in a spiral.
7. other ways to connect the parts that can be considered are an arrangement that allows the holding frame to slide. This is formed by doubling over the connector plate of the inside holding frame, extending it to the prescribed length and inserting the bottom portion of the holding frame into the slot formed by the doubled portion, or joining the connector plate portions with a hinge. The result increases the simplicity of use.

To make a necktie, the user does not tie the necktie in the normal fashion. Instead he crosses both halves and hangs one half of the roll knot (in this case the wider portion) on the outside, as with a muffler or ascot tie. Then, on the exact inside of where they cross, the user folds and overlaps the outside and inside portions of the necktie into a U-shape, inserts both ends into the claw-shaped clip portion and tightens the knot. Because the tips of the claw-shaped portion have a half-moon shape, the edges of the overlapping halves of the necktie can be precisely aligned by sliding the upper part of the necktie material as if drawing a circle and inserting the material so it is not damaged. The clip cannot easily slip off.

Merely inserting the necktie using the holding frame puts tension on the tie from the elasticity from the outside part of the tie, and the tie may slip out of place or come undone. To prevent this the spindle part that is made from material such as plastic and is slightly indented in the center is used as a stopper and inserted into the knot from the bottom part of the frame. Together with the clip the two parts fit together exactly like a nut and bolt, as explained above. This makes it possible to firmly secure the necktie.

In this case the indentation in the center of the spindle is analogous to the threads on a bolt and acts to prevent the tie from returning to the position it had just prior to the stopper being inserted, or from slipping or coming undone.

When the stopper is shaped to form a spindle that is slightly indented in the center when seen from the side, by bending both tips made from a slender long metal plate, the moderate tension in the metal plate acts on the outside as a stopper to hold the inserted necktie in place. When the catch part is bent into a loop shape without making a claw shape or is formed without bending into a spherical or cap shape with rubber or plastic material on both tips, the necktie can be smoothly inserted using moderate tension, while at the same time the strong friction towards the front half makes it hard for the necktie to slip off.

By forming a continuous structure with a plate joining the bottoms of the holding frame U-shape and the ring-shaped inside holding frame, the inside holding frame continues to hold the portion that was the inside backing of the crossed necktie, and action that pulls the inserted portion upwards also occurs. Force will also be added from the front side, forming a knot that will not easily come undone.

Through the action described above, the connected holding frame and inside holding frame structure not only make the stopper unnecessary, the inside holding frame also fulfills the role of a frame holding the essential part of the necktie and serves to give a smart look to the completed necktie.

The inside holding frame can also be made with an elongated structure that does not use the connector plate and that curves in a direct forked shape from the bottom of the U-shaped frame of the holding frame, but the result is nearly the same as with the ring-shaped inside holding form.

It is also possible to make the inside holding frame in a spiral of prescribed length with a single tip instead of the forked shape that wraps around the base portion of the inside of the crossed necktie to form the knot. In this case the invention is uniquely easy to use.

When using a structure to install the connector plate by extending it slightly and doubling it over in a way that allows the holding frame to slide, the user first slides the holding frame part and pulls it completely down to the bottom of the doubled section, then inserts the ring portion of the inside holding frame into the inside of the crossed necktie to support the base. The user then inserts the U-shaped overlapping necktie into the holding frame in one direction using the claw-shaped part, and finally slides the holding frame part back to its original position. The invention is aimed at beginners, enabling even those who are not used to tying a necktie to easily make a knot using the clip.

Because the holding frame portion and the inside holding frame portion can be variably connected using the connector plate, the tie can be made easily by first supporting the inside of the crossed necktie by folding the inside holding frame portion in front, then inserting the overlapped necktie into the U-shape. This is also intended for beginners.

EXPLANATION OF THE NUMBERING

Figure 1:
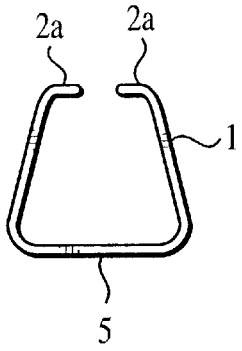
FIG. 1 Front view of the first working example of the invention clip holding frame with a claw-shaped catch section FIG. 2 Angle view of the first working example of the invention clip holding frame with a claw-shaped catch section FIG. 3 Front view of the stopper for the same clip used with the first working example FIG. 4 Bottom view of the stopper for the same clip used with the first working example FIG. 5 Front view showing the invention used to tie a necktie using the clip FIG. 6 Angle view showing the invention used to tie a necktie using the clip FIG. 7 Explanatory figure showing the stopper used to tie a necktie using the clip (rear view)
Figure 2:
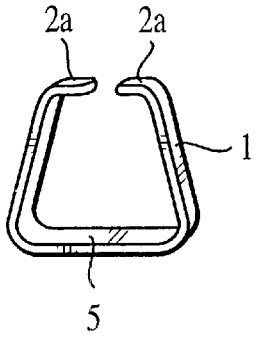

1 Holding frame
2*a* Claw-shaped catch section
2*b* Loop-shaped catch section
2*c* Spherical catch section
2*d* Catch section caps
3*a* Spindle (Stopper)
3*b* Metal plate spindle (Stopper)
4*a* Ring-shaped inside holding frame
4*b* Spiral inside holding frame (=Holder)
4*c* Forked inside holding frame
4*d* Inside holding frame made using wire
5 U-shaped clip

6*a* Indentation of spindle-shaped body
6*b* Indentation of metal plate spindle-shaped body
7*a* Spindle-shaped body shaft
7*b* Metal plate spindle-shaped body shaft
8 Connector plate
9 Fitting section
10 Slide slot
11*a* Front half of necktie
11*b* Inside half of necktie
12 Shirt collar
13*a* Arrow mark showing direction of pull for inside half of necktie
13*b* Arrow mark showing direction of pull for front half of necktie
14 Essential part of the necktie (knotting portion)

DETAILED DESCRIPTION OF THE INVENTION

Basic Working Example

FIGS. 1–7 explain the various parts of the basic working example (First working example) of the invention clip and their use. The invention clip is composed of the holding frame (1) and stopper (3*a*).

Figure 5:
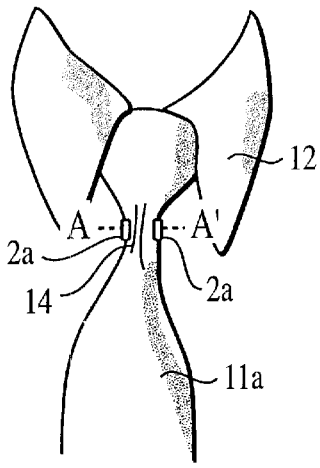
Figure 6:
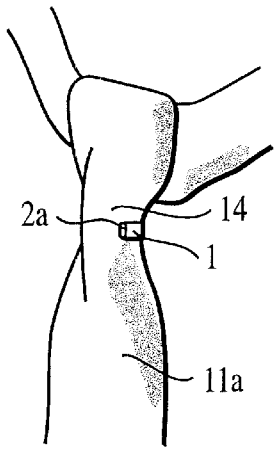
Figure 7:
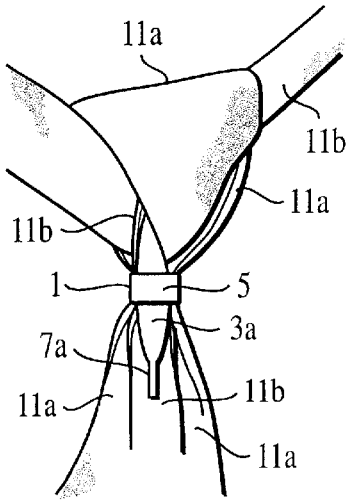

To make a knot, after first inserting the tied necktie section (14) into the holding frame as shown in FIGS. 5 and 6, the user makes the tie by inserting the stopper (3*a*) from below as shown in the rear view of the parts being used in FIG. 7. The holding frame and the stopper have a relationship perfectly analogous to a bolt and nut and work against each other.

The following explains each part in detail. FIG. 1 is the holding frame formed from a narrow metal plate bent into a U-shape (1) and having a claw shape made by extending both tips of this U-shaped frame to form a catch section (2*a*) by bending them at right angles toward the inside. The holding frame with this catch section and a spindle-shaped stopper (3*a*) used with the holding frame comprise the invention clip.

Figure 3:
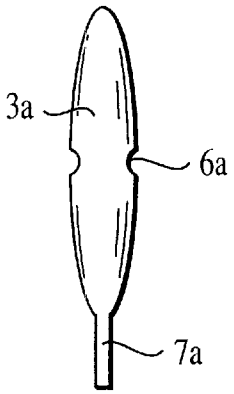
Figure 4:
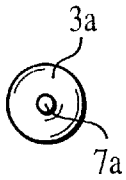

The stopper (3*a*) shown in FIGS. 3 and 4 is made of plastic formed into a spindle, with a slight belt-like indentation (6*a*) in the center portion.

Figure 8:
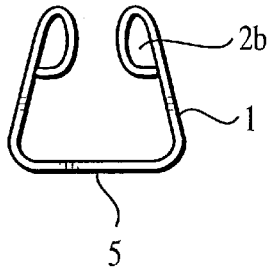
FIG. 8 Front view of the holding frame with the catch section shaped into a loop FIG. 9 Angle view of the holding frame with the catch section shaped into a loop FIG. 10 Front view of the holding frame with the catch section shaped into a sphere FIG. 11 Front view of the holding frame with the catch section shaped with caps FIG. 12 Front view of a stopper made from a metal plate FIG. 13 Bottom view of a stopper made from a metal plate FIG. 14 Front view of the second working example of the invention clip made as a structure with an inside holding frame section FIG. 15 Right-side view of the second working example of the invention clip made as a structure with an inside holding frame section FIG. 16 Angle view of the second working example of the invention clip made as a structure with an inside holding frame section FIG. 17 Angle view of the invention clip made as a structure with the connector plate eliminated and a forked-shape inside holding frame section made directly from the bottom portion of the U-shaped clip FIG. 18 Angle view of the invention clip with the inside holding frame section made into a spiral FIG. 19 Angle view of the invention clip with a U-shaped body made from wire attached to the bottom portion of the inside holding frame section FIG. 20 Side view of the invention clip with the connector plate installed so the doubled-over holding frame section can slide FIG. 21 Section view along A–A' of part of a necktie inserted using the clip (FIG. 5)
Figure 9:
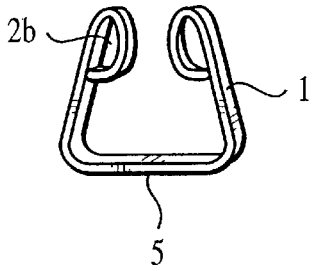
Figure 10:
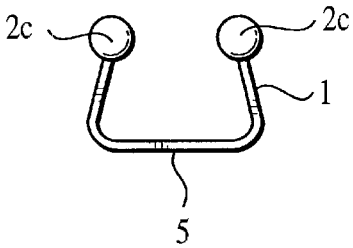
Figure 11:
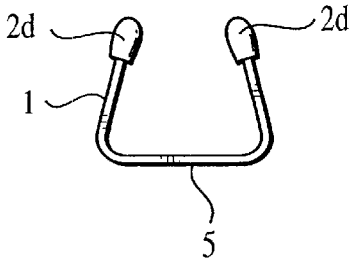

FIGS. 8–11 show variations of the stopper (3*a*) where the tips of the catch section are not formed into a claw shape but are bent into a loop (2*b*) as shown in FIG. 8 and 9, a spherical shape (2*c*) formed from some frictional material such as plastic as shown in FIG. 10, or with caps (2*d*) attached as shown in FIG. 11. With these variations it is possible to achieve nearly the same results as with the claw-shaped catch section in FIGS. 1 and 2.

Figure 12:
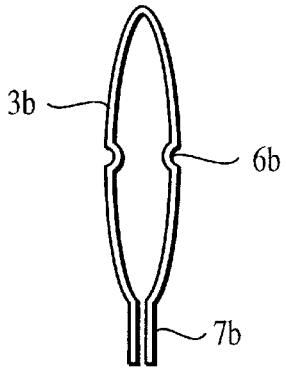
Figure 13:
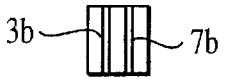

FIGS. 12 and 13 illustrate variations of the stopper. These are formed as a spindle that is indented (6*b*) in the center portion, as shown in the side view of the slender metal plate.

Second Working Example

Figure 14:
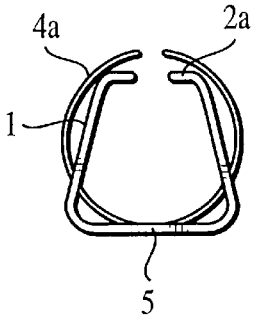
Figure 15:
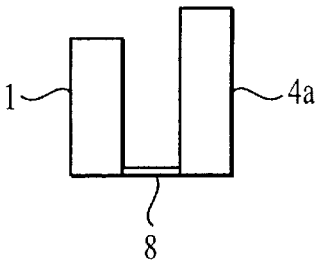
Figure 16:
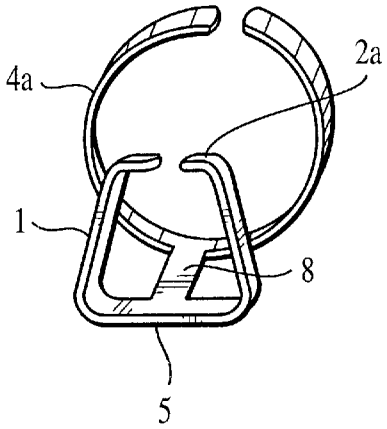

FIGS. 14–16 are illustrations of the second working example of the invention clip, which has been formed so that the stopper is unnecessary. This clip has been formed by adding an inside holding frame (4*a*) formed in the shape of a ring that is slightly open at the tips and connected to the holding frame (1) by means of a short connector plate (8) that joins the bottom of both parts as shown in the angle view in FIG. 16.

Figure 17:
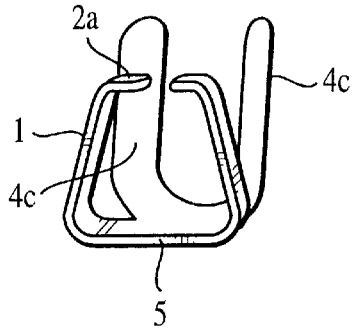

FIGS. 17–20 are variations of the second working example. FIG. 17 shows the bottom part (5) of the U-shaped portion of the holding frame extending perpendicularly and elongated into a continually curved forked U-shape. This portion serves the same function as the inside holding frame (4*c*).

Figure 18:
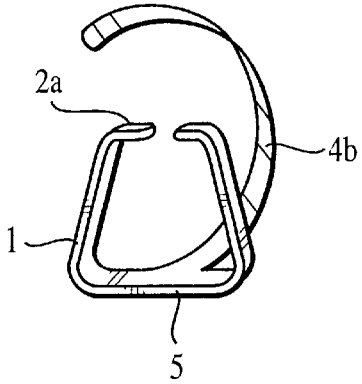

In FIG. 18 the inside holding frame portion is not divided into a fork but is bent and elongated perpendicularly into a single spiral (4*b*) for a prescribed length.

Figure 19:
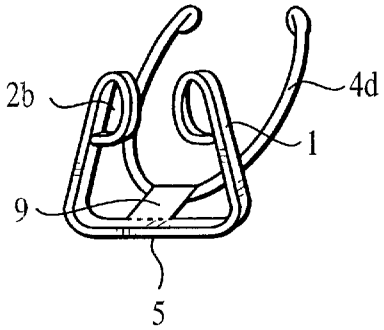

The clip in FIG. 19 used wire for the inside holding frame (4*d*) portion, which is attached to the bottom part of the U-shaped clip itself.

Figure 20:
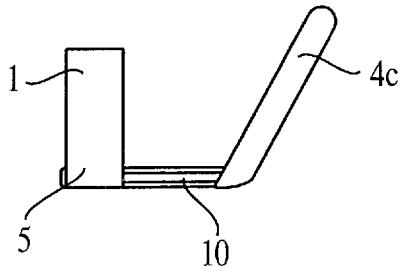
Figure 21:
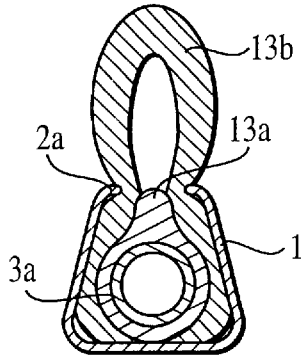
Figure 22:
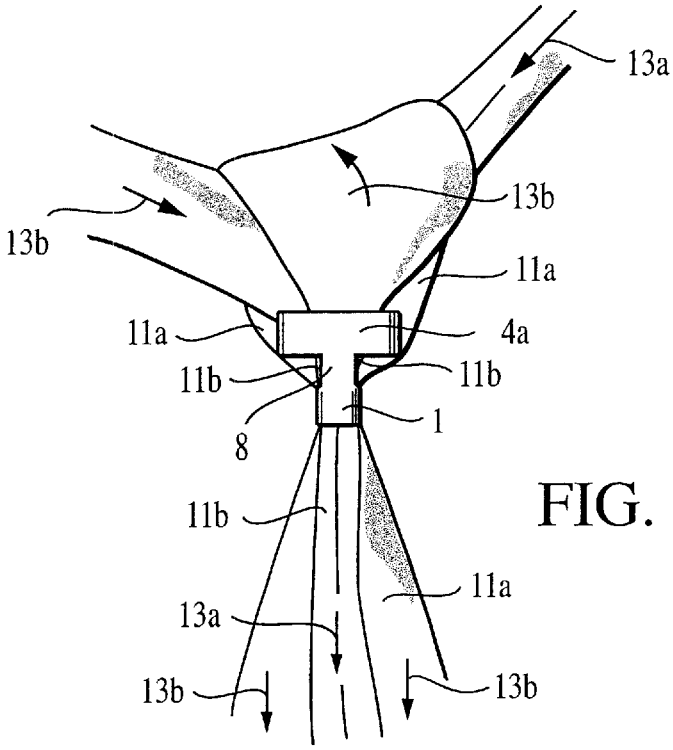
FIG. 22 Explanatory figure showing how a necktie is tied using the clip from the second working example (inside holding frame section+insertion section) (Rear view)

In the working example in FIG. 20, the inside holding frame (4*c*) base portion is doubled over and elongated to a prescribed length to form a slide slot (10), into which the bottom portion of the U-shaped clip (5) is inserted and attached in a manner allowing the user to slide the holding frame.

The first important result of the invention is that the elasticity of the U-shaped clip itself is formed by the "U-shaped clip itself"+the "catch section", and the appropriate friction of the catch section means the assistance of another part such as a screw is not required. This makes it possible to tighten the essential part of the necktie using only the holding frame(1).

As a process the invention makes it possible to complete necktie knotting with basically only one step because the front and inside halves of the necktie are overlapped in a U-shape in the essential part of the necktie and inserted so they can be pushed into the holding frame (1) in that state.

In other words, the one-touch feature and ease with which it is possible to complete the roll-knot tying by just overlapping the front and inside halves of the tie and inserting them can be said to be a new result.

Following this step the invention makes it possible to completely avoid accidental loosening of the knot, merely by insertion of the stopper (3*a*). Obviously, the insertion of the stopper (3*a*) can be done much quicker for a result that is more stable than with similar inventions for which patent application has been made.

In the second working example, by forming the invention from the "holding frame"+the "inside holding frame portion", the inside holding frame part acts as a frame for the essential part of the tie to provide a smart look. Because this also pulls the holding frame upward and makes it impossible for the holding frame portion to drop off, it also makes it unnecessary to use a stopper.

Accordingly, with the second working example the role of the clip as the frame for giving a smart look and the result that makes it unnecessary to use a stopper also are new results.

To return to the earlier topic regarding the effect of the catch section, the claw-shaped catch section makes it possible obtain a result where the necktie fabric can be slid to form a circle and inserted without harming the fabric, and the loop, spherical shape, or capped shape make it possible to obtain a result where the necktie can be smoothly inserted as a result of the shape and the elasticity of the clip material and not easily undone.

It is also clear that the simplicity of the structure make the invention more useful than the quoted inventions for which patent application has been made, for reducing manufacturing costs.

Practicality is achieved by using the clip in conjunction with the stopper to counteract unexpected force acting to loosen the knot. With the second working example, however, the invention is perfected as the ideal roll-knot clip because even the stopper is unnecessary.

That is to say, the invention completely solves the problems found with the quoted inventions.

Resolution of the problems found with the quoted inventions means the problems have been resolved in the broad sense.

In other words, despite the marked increase in the number of applications submitted to the Patent Agency for inventions concerning simple necktie knot clips, the dream of men who have wanted to tie a necktie easily with one simple step has not been realized. The reason is self-evident if we think of today's actual necktie use.

Therefore the invention has made it possible to realize the dream of being able to easily tie a necktie with one step.

The final merit of the invention clip is that any necktie available can be used as is and tied without having to make any changes to the tie.

Generally, neckties have survived because of the freedom that enabled users to select from a nearly unlimited variety.

Nearly all of the simple necktie clips submitted to the Patent Agency can only be used with neckties specifically made for use with that clip, which sacrifices freedom of choice. This weakness is their major fault.

Although some of these inventions have been well designed, they cannot in fact be chosen and utilized.

The invention clip possesses the flexible function of allowing users to freely use neckties they already own and does not suffer from any of the sacrifices required in the past, making it possible to enjoy the convenience of one-step knot tying.

The maneuver of tying a roll-know is different from those for knots such as Windsor knot, because the knot is not clearly visible. People who prefer a clear knot may be dissatisfied. However, the roll knot has the different aesthetic attraction of being three-dimensional and simple in appearance.

For men's lives, however, if something is truly convenient it will spread throughout the world like water flowing downhill. This is what we mean when we say a problem is solved in the broad sense.

What is claimed is:

1. A roll-knot necktie clip comprising a holding frame (1) and an inside holding frame **(4*a*) in the shape of a ring that is slightly open at both tips, which together form a continuous structure joined by a short plate-shaped connector plate (8)**, whereby one portion of a necktie wrapped around a collar of a user is inserted into said inside holding frame, an other portion is folded back over said one portion and then both of the portions are inserted into said holding frame to thereby provide a roll-knot for said necktie.

2. The roll-knot necktie clip according to claim 1, which is characterized by elongating the bottom portion of the U-shaped body (5) and bending it into a direct fork to form the inside holding frame **(4*c*)**.

3. The roll-knot necktie clip according to claim 1, which is characterized by elongating the bottom portion of the U-shaped body (5) and bending it into a direct spiral **(4*b*) to form the inside holding frame (4*c*)**.

4. The roll-knot necktie clip according to claim 1 wherein both said holding frame and said inside holding frame are made from a resilient material.

5. The roll-knot necktie clip according to claim 4 wherein said holding frame (1) consists of a slender, short metal plate bent to make a U-shaped body (5) and a catch section **(2*a*)** made by elongating both tips of the U-shaped body and bending them respectively at right angles towards an inside of said U-shaped body.

* * * * *